US009599390B2

(12) United States Patent
Galvin et al.

(10) Patent No.: US 9,599,390 B2
(45) Date of Patent: Mar. 21, 2017

(54) DEVICE FOR PRODUCING ARTIFICIAL SNOW, AND METHOD FOR PRODUCING ARTIFICIAL SNOW

(71) Applicants: Michel Galvin, Carquefou (FR); Eric David, Treillieres (FR); Karlheinz Terrabona, Marebbe/Enneberg-Corte/Hof (IT)

(72) Inventors: Michel Galvin, Carquefou (FR); Eric David, Treillieres (FR); Karlheinz Terrabona, Marebbe/Enneberg-Corte/Hof (IT)

(73) Assignee: TECHNOALPIN FRANCE SAS, Dardilly (FR)

( * ) Notice: Subject to any disclaimer, the term of this patent is extended or adjusted under 35 U.S.C. 154(b) by 0 days.

(21) Appl. No.: 14/467,815

(22) Filed: Aug. 25, 2014

(65) Prior Publication Data

US 2015/0053785 A1 Feb. 26, 2015

(30) Foreign Application Priority Data

Aug. 26, 2013 (FR) ..... 13 58168

(51) Int. Cl.
*F25C 3/04* (2006.01)
*F25C 3/00* (2006.01)

(52) U.S. Cl.
CPC ..... *F25C 3/04* (2013.01); *F25C 2303/046* (2013.01); *F25C 2303/048* (2013.01); *F25C 2303/0481* (2013.01)

(58) Field of Classification Search
CPC F25C 3/04; F25C 2303/046; F25C 2303/048; F25C 2303/0481
(Continued)

(56) References Cited

U.S. PATENT DOCUMENTS 3,945,567 A * 3/1976 Rambach ..... F04F 5/466 239/132.5
3,948,442 A * 4/1976 Dewey ..... F25C 3/04 239/2.2

(Continued)

FOREIGN PATENT DOCUMENTS

SU 1 513 348 A1 10/1989
WO 01/86216 A1 11/2001
WO 2009/061722 A1 5/2009

OTHER PUBLICATIONS

French Search Report, dated Apr. 24, 2014, from corresponding FR application.

*Primary Examiner* — Darren W Gorman
(74) *Attorney, Agent, or Firm* — Young & Thompson

(57) ABSTRACT

A device for producing artificial snow includes: elements (100) for producing a central jet (101) consisted by a first fluid chosen among air or water; elements (110) for producing a peripheral jet (111) consisted by a second fluid chosen among water or air and different from the first fluid; and nucleation elements (120) for the production of at least one nucleation jet (121). The elements for producing the central jet and the elements for producing the peripheral jet are arranged in such a manner that the opposite contours (103, 114) of their respective jets each define a generating line, which opposite generating lines extend parallel or at least approximately parallel to each other; moreover, the nucleation elements (120) are distributed over the external periphery of the elements (110) for producing the peripheral jet (111).

17 Claims, 3 Drawing Sheets

(58) Field of Classification Search
USPC ..... 239/2.2, 14.2
See application file for complete search history.

(56) References Cited

U.S. PATENT DOCUMENTS

| | | | | | |
|---|---|---|---|---|---|
| 3,979,061 | A * | 9/1976 | Kircher | F25C 3/04 | 239/14.2 |
| 4,004,732 | A * | 1/1977 | Hanson | F25C 3/04 | 239/14.2 |
| 4,223,836 | A * | 9/1980 | Eager | F25C 3/04 | 239/14.2 |
| 4,597,524 | A * | 7/1986 | Albertsson | F25C 3/04 | 239/14.2 |
| 4,682,729 | A * | 7/1987 | Doman | F25C 3/04 | 239/14.2 |
| 5,400,966 | A * | 3/1995 | Weaver | F25C 3/04 | 239/14.2 |
| 6,378,778 | B1 * | 4/2002 | Luras | F25C 3/04 | 239/14.2 |
| 6,691,926 | B1 * | 2/2004 | Moen | F25C 3/04 | 239/14.1 |
| 2009/0114735 | A1 * | 5/2009 | Collins | F25C 3/04 | 239/2.2 |

* cited by examiner

DEVICE FOR PRODUCING ARTIFICIAL SNOW, AND METHOD FOR PRODUCING ARTIFICIAL SNOW

TECHNICAL FIELD TO WHICH RELATES THE INVENTION

The present invention generally relates to the making of culture snow (also called artificial snow).

It relates in particular to a device for making artificial snow from the production and the projection of an air jet, a water jet and a nucleation jet.

The invention also relates to a method for making artificial snow.

TECHNOLOGICAL BACK-GROUND

Ski tracks are arranged to receive in particular natural snow, for example for practicing alpine skiing or cross-country skiing.

Generally, it is known to make artificial snow to place it on the ski tracks to compensate for lack of natural snow.

For that purpose, as described in the documents WO-2009/061722 or WO-01/86216, snowmakers called fan guns may be used, in which water for the production of snow, projected by spraying nozzles, is mixed with an air flow produced by a turbine, in association with nucleation means.

This turbine is formed by a propeller driven into rotation in a pipe by a motor. At its outlet, this pipe is surrounded by water spraying nozzles arranged so as to project water jets along an axis of projection converging towards the axis of projection of the air flow, to realise the desired air/water mixture.

But the snowmakers of this type require a relatively high ventilation power (generally of the order of 12 to 20 kW) to allow the air flow to carry along the water and to mix up with the fine droplets formed, in good conditions, and over a significant distance.

This required power is a source of cost both regarding the structure of the materials implemented and regarding the consumption of energy.

OBJECT OF THE INVENTION

The present invention has for object to remedy these drawbacks by proposing a device that allows to produce a good quality artificial snow while reducing the ventilation power required.

For that purpose, it is proposed according to the invention a device for producing artificial snow comprising:

- means for producing a central jet consisted by a first fluid chosen among air or water, said central jet having an external contour and an axis of projection,
- means for producing a peripheral jet consisted by a second fluid chosen among water or air and different from said first fluid, which peripheral jet has a generally tubular shape defining an internal contour and an axis of projection, which peripheral jet is intended to be projected over the whole or substantially the whole periphery of the central jet, and
- nucleation means for the production of at least one nucleation jet intended to form crystals of ice, to favour the production of artificial snow from the cooperation of the central and peripheral jets;

and this device is characterized by the fact that the means for producing the central jet and the means for producing the peripheral jet are arranged in such a manner that the opposite contours of their respective jets each define a generating line, which opposite generating lines extend parallel or at least approximately parallel to each other, at least in their initial portion, following their production, and by the fact that the nucleation means are distributed over the external periphery of the means for producing the peripheral jet.

The structure of this device ensures a protection of the central jet by the peripheral jet, and uses in part the energy of water, so as to delay and optimize the mixing between, on the one hand, the air and water jets for the production of artificial snow, and on the other hand, the ambient air.

The means for producing the central jet and the means for producing the peripheral jet are arranged in such a manner that their opposite contours are generally cylindrical, conical or elliptical in shape.

Preferably, the peripheral jet is projected over the whole or substantially the whole periphery of the central jet, concentrically or approximately concentrically to each other.

Still preferably, the generating lines of the opposite contours of the central jet and the peripheral jet define between each other an angle comprised between −5° and +5° (and preferably between −3° and)+3°.

According to a preferred embodiment, the means for producing the peripheral jet are intended to project water, and the means for producing the central jet are intended to project air.

Within this framework, the means for producing the central jet of air and the means for producing the peripheral jet of water are preferably arranged so that the internal contour of the peripheral jet of water conforms, at least approximately, the external contour of the central jet of air.

According to still another characteristic, the means for producing the peripheral jet of water are structured for the projection of a juxtaposition of a plurality of individual jets of water intended to form together the peripheral jet of water, each of the individual jets of water being intended to extend tangentially, or substantially tangentially, to the external contour of the central jet of air.

The means for producing the peripheral jet of water are structured for the projection of a juxtaposition of a plurality of individual jets of water each having a cross section generally flat, conical or elliptical in shape.

According to a particular embodiment, the means for producing the peripheral jet of water comprise at least one crown of nozzles adapted to each project one of the individual jets of water.

According to another embodiment of the invention, the means for producing the peripheral jet are intended to project air, and the means for producing the central jet are intended to project water.

Within this framework, the means for producing the central jet of water comprise at least one nozzle adapted to project an individual jet of water.

According to another distinctive feature of the invention, the means for producing the air jet comprise a pipe provided with an outlet delimited by an outer envelope and possibly by an inner envelope, intended to define the external contour and possibly the internal contour, respectively, of the air jet.

According to an interesting characteristic, this pipe may be equipped with a planar support ring whose front face, perpendicular to the longitudinal axis of said pipe, serves as a support for nozzles constituting the means for producing the peripheral jet of water and/or for nozzles constituting the nucleation means.

This support ring is advantageously delimited by an internal edge and by an external edge, separated from each other by a radial distance comprised between 15 and 25 cm.

Still according to another distinctive feature, the axis of projection of the nucleation jet of the nucleation means defines a converging angle, towards the peripheral jet, comprised between 0° and 15° with respect to the axis of projection of the central jet.

The invention also proposes a method for producing artificial snow, comprising:

the production of a central jet consisted by a first fluid chosen among air or water, said central jet having an external contour and an axis of projection, the production of a peripheral jet consisted by a second fluid chosen among water or air and different from said first fluid, said peripheral jet having a generally tubular shape defining an internal contour and an axis of projection, said peripheral jet being intended to be projected over the whole or substantially the whole periphery of said central jet, and the production of at least one nucleation jet intended to form crystals of ice, to favour the production of artificial snow from the cooperation of the central jet and the peripheral jet, wherein the nucleation jet(s) are distributed over the external periphery of said central and peripheral jets, and wherein the opposite contours of the central and peripheral jets extend parallel or at least approximately parallel to each other, at least in their initial portion, following their production.

According to a particular characteristic, the water jet has a speed equal to the speed of the air jet, to within 20%.

In a particular embodiment, the water jet has a higher speed than the speed of the air jet.

DETAILED DESCRIPTION OF EXEMPLARY EMBODIMENTS

The invention will be further illustrated, without being limited in anyway, by the following description of various particular embodiments, given only by way of example and shown in the appended drawings, in which.

Beforehand, it will be noted that from one figure to the other, the identical a similar elements of the different embodiments and variants of the invention will be, as far as possible, denoted by the same reference signs and will not be described every time.

A snow gun is designed to produce artificial snow from water and air, in particular so as to compensate for lack of natural snow on the ski tracks.

Such a snow gun, of the commonly called "fan gun" type, conventionally includes a framework and a pipe comprising means to produce and project, on a same side of the pipe and in a same direction, water, air and nucleation jets allowing the formation of artificial snow. The air jet is formed by a turbine consisted of a propeller driven into rotation by a motor; and the water jet is obtained by means of spraying nozzles connected to the pressurized water system.

The framework is generally mobile with respect to the ground to allow its displacement the nearest possible of the ski tracks and the pipe is generally mounted mobile on the framework.

Figure 1:
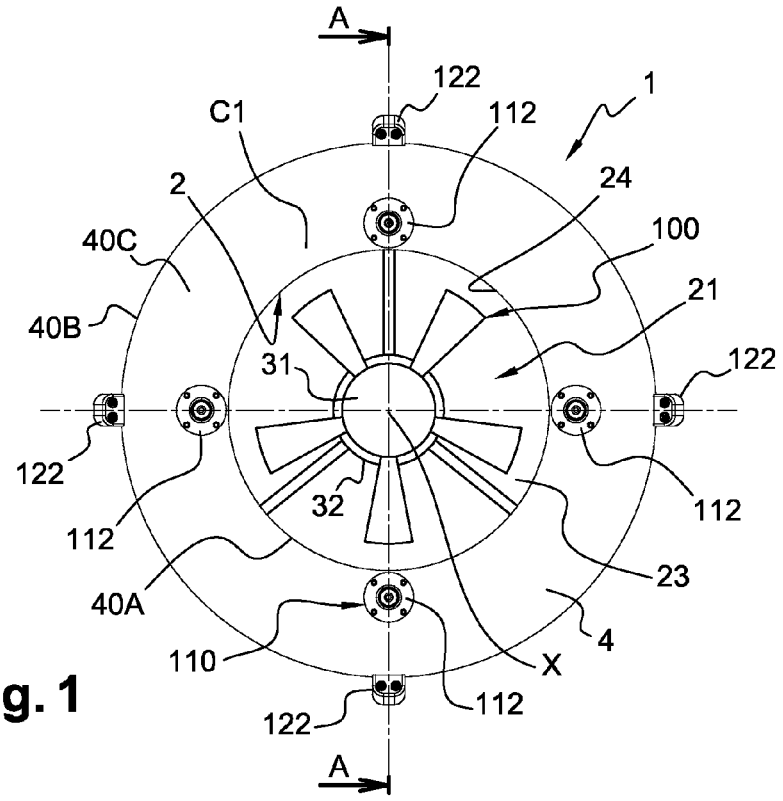
FIG. 1 is a schematic front view of a first embodiment of a device for producing artificial snow according to the invention.
Figure 2:
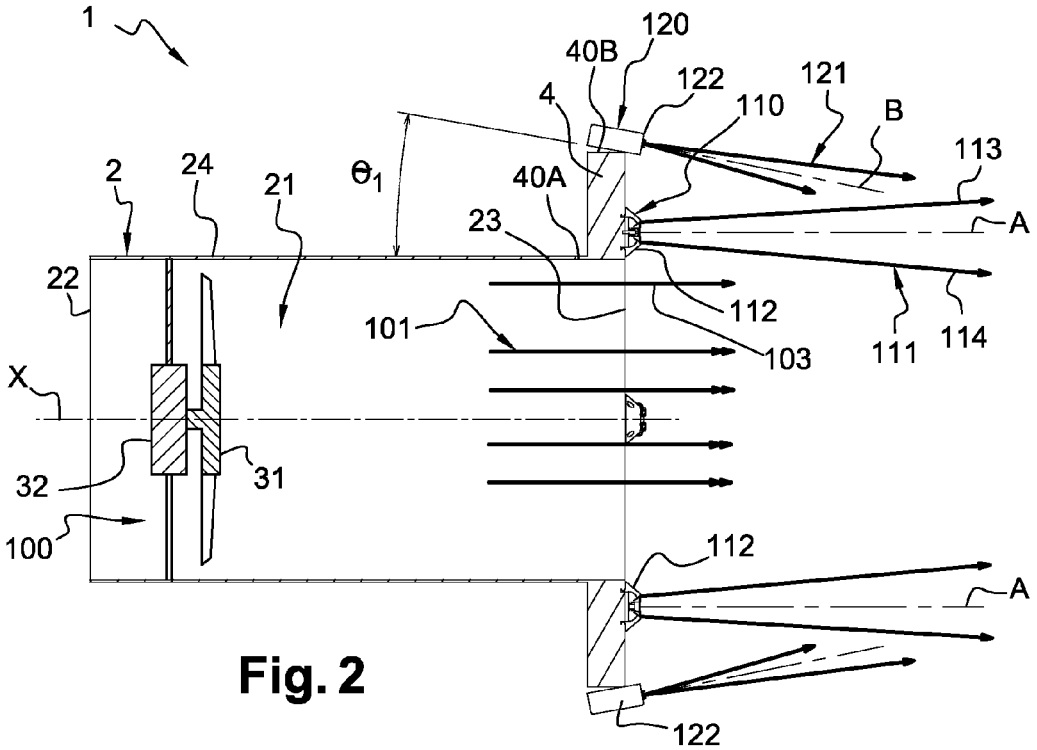
FIG. 2 is a sectional view of the device of FIG. 1 according to the section plane A-A.
Figure 3:
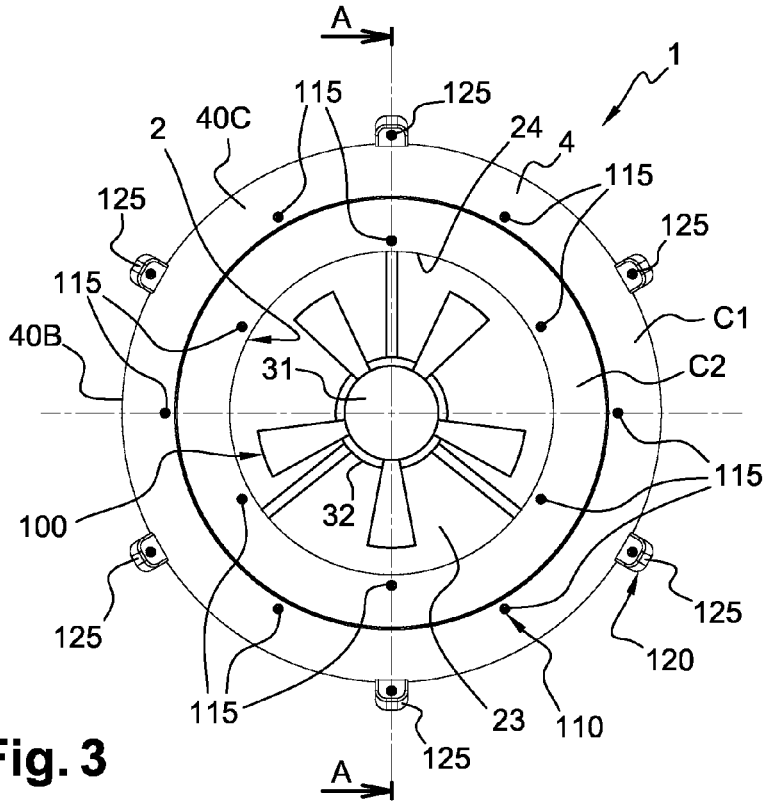
FIG. 3 is a schematic front view of an alternative embodiment according to the invention of the device of FIG. 1.
Figure 4:
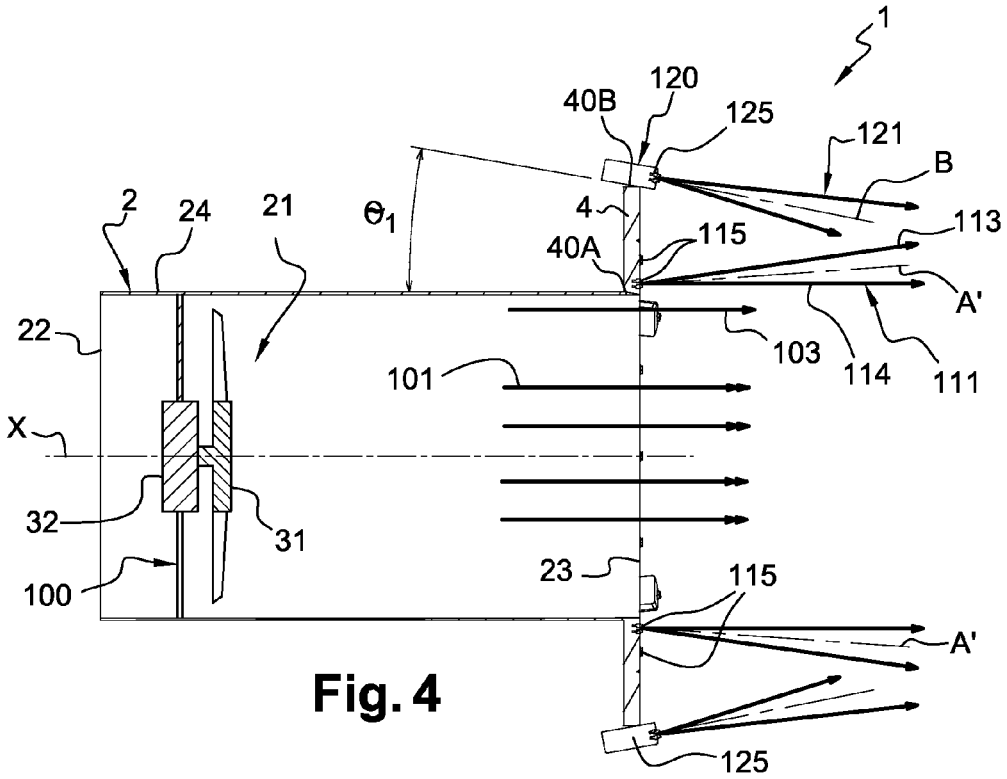
FIG. 4 is a sectional view of the device of FIG. 3 according to the section plane A-A.
Figure 5:
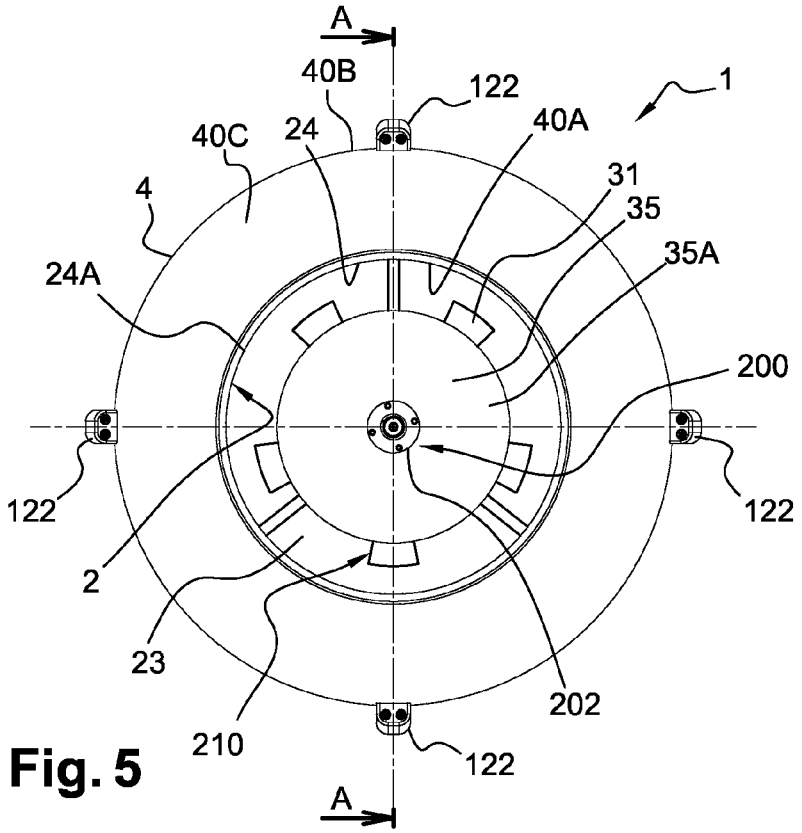
FIG. 5 is a schematic front view of a second embodiment of a device for producing artificial snow according to the invention.
Figure 6:
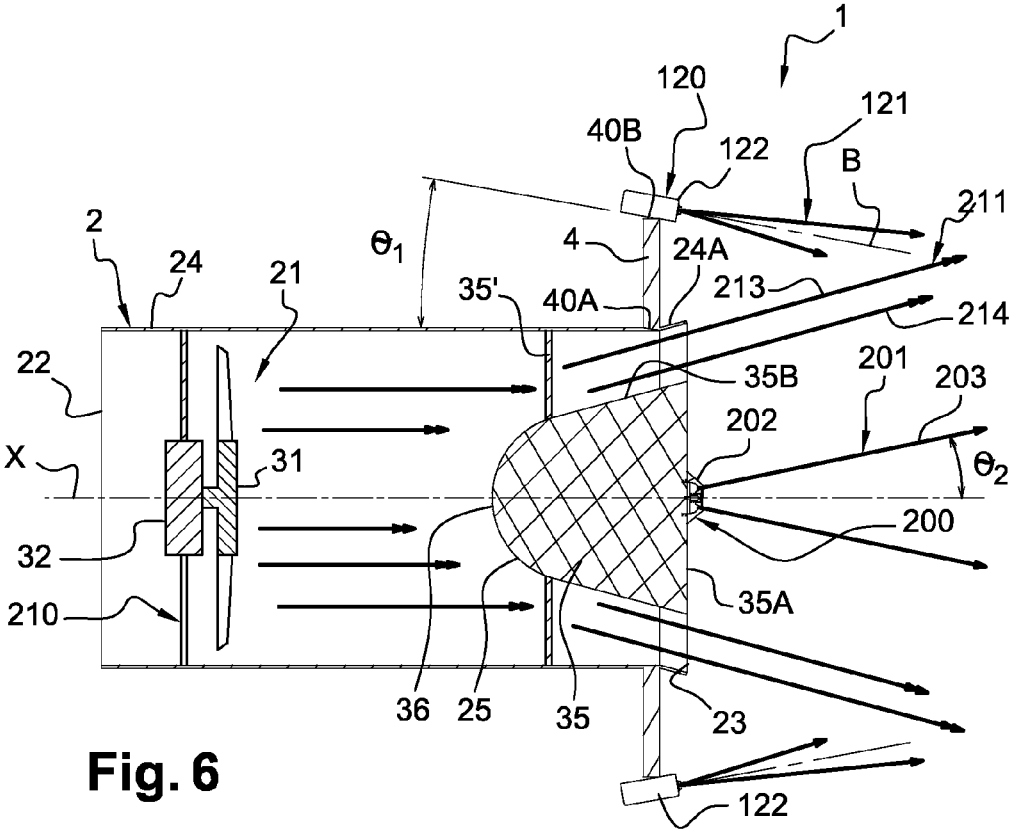
FIG. 6 is a sectional view of the device of FIG. 5 according to the section plane A-A.

Two embodiments of such a snow-gun device 1 have been shown in FIGS. 1 to 4 and in FIGS. 5 and 6, respectively. FIGS. 3 and 4 illustrate an alternative embodiment of the first embodiment of the device 1 of FIGS. 1 and 2.

In all the embodiments illustrated in the figures, this device 1 comprises a pipe 2. This pipe 2 is generally shaped as a hollow cylinder extending along a longitudinal axis X to delimit an inner housing 21, and two opposite orifices 22, 23.

This device 1 also comprises means 100; 200 for producing, on the side of an outlet 23 of the pipe 2, a central jet 101; 201 consisted by a first fluid chosen among air or water.

This device 1 further comprises means 110; 210 for producing, on the side of the outlet 23 of the pipe 2, a peripheral jet 111; 211 consisted by a second fluid chosen among water or air and different from the first fluid. These means 110; 210 are more particularly arranged to project the peripheral jet 111; 211, which has a generally tubular shape, over the whole or substantially the whole periphery of the central jet 101; 201, concentrically or approximately concentrically to each other.

This device 1 finally comprises nucleation means 120 for the production, on the side of the outlet 23 of the pipe 2, of at least one nucleation jet 121 intended to form crystals of ice, so as to favour the production of artificial snow from the cooperation of the central jet 101; 201 and the peripheral jet 111; 211.

According to the invention, the means 100; 200 for producing the central jet 101; 201 and the means 110; 210 for producing the peripheral jet 111; 211 are arranged in such a manner that the opposite contours 103, 114; 203, 214 of their respective jets each define a generating line, which opposite generating lines extend parallel or at least approximately parallel to each other; and the nucleation means 120 are distributed over the external periphery of the means 110; 210 for producing the peripheral jet 111; 211 (these nucleation means are advantageously arranged to project the nucleation jet(s) 121 towards the central 101; 201 and peripheral 111; 211 jets).

In other words, the means 100; 200 for producing the central jet 101; 201 and the means 110; 210 for producing the peripheral jet 111; 211 are arranged so that the inner contour 114; 214 of the peripheral jet 111; 211 extends parallel or substantially parallel around the outer contour 103; 203 of the central jet 101; 201, at the outlet 23 of the pipe 2, and that from their origin up to a certain distance from their production means 100, 110; 200, 210.

It is meant by "substantially parallel" that the generating lines of the external contour 103; 203 of the central jet 101; 201 and of the internal contour 114; 214 of the peripheral jet 111; 211 define between each other an angle comprised between −5 degrees and +5 degrees, and preferably comprised between −3 degrees and +3 degrees.

That way, the peripheral jet 111; 211 surrounds the central jet 101; 201 to form an envelope that delays the thermal exchanges between the central jet 101; 201 and the atmosphere. In other words, the desired effect is herein to propel a peripheral jet 111; 211 around the central jet 101; 201 to limit the slowing down of the central jet 101; 201 by the atmosphere. Moreover, the energy of the water jet is used in the best way and the power required for it to be carried along by the air is limited.

Such a device 1 for producing artificial snow has a simple and reliable structure, allowing to produce artificial snow with an optimal output and that with a limited fan power with respect to that required with the prior art devices.

As will be exposed in more detailed hereinafter, in the first embodiment of the invention (see FIGS. 1 to 4), the means 110 for producing the peripheral jet 111 are intended to project water, and the means 100 for producing the central jet 101 are intended to project air. Conversely, in the second embodiment of the invention (see FIGS. 5 and 6), the means 210 for producing the peripheral jet 211 are intended to project air, and the means 200 for producing the central jet 201 are intended to project water.

According to the first embodiment shown in FIGS. 1 to 4, the pipe 2 has a hollow cylindrical shape extending along the longitudinal axis X and is limited by an outer envelope 24. The outlet 23 of the pipe 2 has herein a section of circular shape extending in a plane perpendicular to the longitudinal axis X, and its inner housing 21 has a cylindrical shape.

The means 100 for producing the central jet of air 101 are arranged in the inner housing 21 of the pipe 2 and consist of a propeller 31 driven by an electric motor 32 fixed to the outer envelope 24 of the pipe 2. Therefore, the outer envelope 24 is adapted, through its face directed towards the inner housing 21, to guide and shape the air flow up to the outlet 23, along an axis of projection carried by the longitudinal axis X.

As shown in FIGS. 1 to 4, the pipe 2 comprises a planar support ring 4 on which are arranged the means 110 for producing the peripheral jet of water 111 and the nucleation means 120 for producing the nucleation jet 121.

The support ring 4 extends, from one end of the outer envelope 24 directed towards the outlet 23, in a plane perpendicular to the longitudinal axis X of the pipe 2, at the opposite of the inner housing 21. It is delimited by an internal edge 40A and by an external edge 40B, separated from each other by a radial distance that may be comprised between 15 centimeters and 25 centimeters.

The means 110 for producing the peripheral jet of water 111 herein include four nozzles 112 for spraying an individual jet of water, arranged in the support ring 4, so that they come out at a front face 40C of the latter. The four spraying nozzles 112 are arranged on a fictive crown C1 centred on the longitudinal axis X.

These four spraying nozzles 112 are regularly arranged about the longitudinal axis X. More particularly, they are spaced from each other two-by-two by a quarter circle perimeter to each spray an individual jet of pressurized water along an axis of spraying A parallel or substantially parallel to the longitudinal axis X to form said peripheral jet of water 111.

Each nozzle 112 for spraying pressurized water is adapted to spray an adjustable individual jet of water having a solid or hollow, generally flat, conical or elliptical shape, in the form of water droplets whose size is preferentially comprised between 100 micrometers and 800 micrometers.

Fixed-section or variable-section nozzles may for example be used, as described in the document EP-1 386 668.

The nucleation means 120 are herein arranged on the external edge 40B of the support ring 4, each in such a manner to project a nucleation jet 121 along an axis of projection B inclined towards the longitudinal axis X of the pipe 2, on the side of the outlet 23 thereof. This axis of projection B forms with the longitudinal axis X of the pipe 2 an angle θ1 comprised between −15 degrees and +15 degrees.

The means 120 for producing nucleation jets 121 include four couples of nucleation nozzles 122, regularly distributed about the longitudinal axis X. More particularly, these couples of nucleation nozzles 122 are each spaced from each other two-by-two by a quarter circle perimeter, in line or substantially in line with the corresponding water spraying nozzle 112. The couples of nucleation nozzles 122 are arranged on a circle centred on the longitudinal axis X.

Each nucleation nozzle 122 propels a nucleation mixture, formed of pressurized water and air, intended to form crystals of ice, to favour the production of artificial snow from the cooperation of the central jet of air 101 and the peripheral jet of water 111.

In practice, for the production of artificial snow from the device 1 of FIGS. 1 and 2, the central jet of air 101, the peripheral jet of water 111 and the nucleation jet 121 are produced simultaneously by activation of dedicated control means.

To generate the central jet of air 101, the propeller 31 is rotated so as to create a vacuum in the inner housing 21 of the pipe 2, which forms a aspiration of air at the inlet 22, and said central jet of air 101 at the outlet 23.

Hence, the central jet of air 101 is herein solid and has a section delimited by an external contour 103 of circular shape when exiting the outlet 23. In a not-shown alternative embodiment, the pipe 2 may have an elliptical section for the projection of a central jet of air whose external contour is elliptic at the outlet 23.

To generate the peripheral jet of water 111, the water spraying nozzles 112 are fed by pressurized-water supply means so as to spray each individual jet of water in the form of droplets. The peripheral jet of water 111 is herein hollow, of annular or conical shape. It has herein a section delimited by an external contour 113 and an internal contour 114, generally circular in shape.

In a not-shown alternative embodiment, it could be contemplated to arrange differently the spraying nozzles so that the peripheral jet of water has an elliptical internal and/or external contour.

The internal contour 114 of the peripheral jet of water 111 hence delimits the volume, inside which the central jet of air 101 is projected.

For an optimal production of snow, the peripheral jet of water 111 is projected over the whole perimeter of the central jet of air 101, so that the internal contour 114 of the peripheral jet of water 111 and the external contour 103 of the central jet of air 101 extend parallel or substantially parallel to each other at the outlet 23 of the pipe 2.

More particularly, the internal contour 114 of the peripheral jet of water 111 conforms at best the external contour 103 of the central jet of air 101 at least near the outlet 23 of the pipe 2.

Hence, the central jet of air 101 is a little "protected" and/or "isolated" from the atmosphere by the peripheral jet of water 111, up to a certain distance from the outlet 23 of the pipe 2.

This distance depends in particular on the shape and speed of the peripheral jet of water 111 and the central jet of air 101.

Furthermore, the perturbations of displacement of the water jet by the air jet are limited.

The peripheral jet of water 111 and the central jet of air 101 are advantageously propelled at speeds identical to each other, to within 20%.

Possibly, it may be provided that the peripheral jet of water 111 has a speed higher by at least 20% than the speed of the central jet of air 101.

To generate the nucleation jet 121, the nucleation nozzles 122 are suitably connected to nucleation fluid production means. Hence, this nucleation jet 121 is herein composed of a plurality of individual nucleation jets propelled, by the nucleation nozzles 122, towards the peripheral jet of water 111 and the central jet of air 101.

The nucleation nozzles 122, which are arranged on the external edge 40B of the support ring 4 produce a nucleation jet 121 forming a turbulence or jump that delays the coupling/mixing between the peripheral jet of water 111 and the central jet of air 101.

According to the alternative embodiment of the device 1 of FIGS. 1 and 2, shown in FIGS. 3 and 4, the means 112 for producing the peripheral jet of water 111 comprise several crowns C1, C2 of water spraying nozzles 115 arranged in the support ring 4. They also protrude from the support ring 4, at the front face 400 thereof.

These crowns C1, C2 of water spraying nozzles 115 are arranged concentrically to the longitudinal axis X and they are angularly offset relative to each other.

Each crown C1, C2 herein comprises six water spraying nozzles 115, but it could be contemplated according to an alternative embodiment that they include a different number thereof, for example between 4 and 10 water spraying nozzles. These spraying nozzles 115 are herein of the "Fan Jet" type and are adapted to each project a fixed-geometry flat individual jet, along an axis of propulsion A' that slightly diverges in the direction of propulsion of said individual jet. This axis of propulsion A' forms with the longitudinal axis X of the pipe 2 an angle comprised between 0 and 5 degrees, so that the inner contour 114 of the peripheral jet of water 111 extends parallel or substantially parallel to the outer contour 103 of the central jet of air 101.

Still according to this alternative embodiment, the means 120 for producing the nucleation jet 121 include six nucleation nozzles 125, each arranged on the external edge 40B of the support ring 4. They are also regularly arranged about the longitudinal axis X and are angularly spaced from each other two-by-two by one sixth of circle perimeter. More particularly, as shown in FIG. 3, each nucleation nozzle 125 is herein arranged in line or substantially in line with a water spraying nozzle 115 of the inner crown C2.

The method of implementation of this alternative embodiment of FIGS. 3 and 4 is similar to that described hereinabove in relation with FIGS. 1 and 2. It is distinguished therefrom by the fact that the peripheral jet of water 111 is consisted by the expansion of the individual jets of water of the spraying nozzles 115 of the two crowns C1, C2.

These two crowns C1 and C2 may operate independently from each other, or simultaneously.

According to the second embodiment shown in FIGS. 5 and 6, the central jet 201 is consisted by a first fluid of pressurized water and the peripheral jet 211 is consisted by a second fluid of air.

Unlike the first embodiment shown in FIGS. 1 to 4, the pipe 2, which has a generally cylindrical shape, extending along the longitudinal axis X, is delimited by an outer envelope 24 and an inner envelope 25.

This inner envelope 25 is formed by a support element 35 of generally conical shape, which is arranged in the inner housing 21 of the pipe 2, and which is fixed to the outer envelope 24 of the pipe 2 by any suitable means, for example tension rods 35'.

This support element 35 comprises—a planar front face 35A perpendicular to the longitudinal axis X of the pipe 2 in the plane of the outlet 23, —a tip 36 arranged in the inner housing 21 of the pipe 2, opposite the front face 35A, and—a truncated junction face 35B extending between the tip 36 and the front face 35A.

The front face 35A of the support element 35 is circular, so that the outlet 23 of the pipe 2 has a ring-shaped or crown-shaped section extending in an plane perpendicular to the longitudinal axis X.

The means 200 for producing the central jet of water 201 herein include a single spraying nozzle 202 arranged at the centre of the front face 35A of the support element 35, in protrusion from the latter.

This spraying nozzle 202 is adapted to spray an individual jet of water along an axis of spraying carried by the longitudinal axis X, which forms alone said central jet of water 201.

This pressurized-water spraying nozzle 202 is adapted to spray an adjustable individual jet of water having a solid or hollow, generally conical or elliptical shape, in the form of water droplets, whose size is preferentially comprised between 100 micrometers and 800 micrometers.

Fixed-section or variable-section nozzles may for example be used, such as described in the document EP-1 386 668. As a variant, several nozzles may be used to form the central jet of water. Nozzles producing a dissymmetric jet may also be used.

This spraying nozzle 202 is adjusted so that the external contour 203 of the central jet of water 201 forms a generating line, which consists in a straight line inclined, with respect to the longitudinal axis X of the pipe 2, by an angle θ2 comprised between 10 degrees and 40 degrees, preferentially equal or close to 30 degrees. This angle may not be regular if one or several dissymmetric jet nozzles are used.

The means 210 for producing the peripheral jet of air 211 are arranged in the inner housing 21 of the pipe 2 and they consist in a propeller 31 driven by an electric motor 32 fixed to the outer envelope 24 of the pipe 2. Hence, the outer envelope 24 and the inner envelope 25 are adapted to guide and shape the air flow up to the outlet 23 of the pipe 2, along an axis of projection carried by the longitudinal axis X.

The outer envelope 24 and the inner envelope 25 of the pipe 2 have herein a particular shape, adapted so that the inner contour 214 of the peripheral jet 211 is parallel or substantially parallel to the outer contour 203 of the central jet of water 201.

More particularly, the junction face 35B of the support element 35 forms a generating line that consists in a straight line inclined by an angle θ2 with respect to the longitudinal axis X of the pipe 2.

Hence, due to this inclination, the internal contour 214 of the peripheral jet of air 211 is guided by this junction face 35B to be projected parallel to the external contour 203 of the central jet of water 201 at the outlet 23 of the pipe 2.

So as to reduce the turbulences at the outlet 23 of the pipe 2, the end of the external envelope 24 of the pipe 2 includes a crown 24A that flares according to the same above-mentioned angle of inclination θ2.

The device 1 shown in FIGS. 5 and 6 comprises, similarly to that shown in FIGS. 1 and 2, a planar support ring 4 on which are arranged the nucleation means 120 for the production of the nucleation jet 121.

Similarly to the device 1 of FIGS. 1 and 2, that shown in FIGS. 5 and 6 also comprises means 120 for producing the nucleation jet 121 propelled about the axis of projection B inclined with respect to the longitudinal axis X of the pipe 2, preferably according to an angle θ1 comprised between 0 degrees and 20 degrees, advantageously of the order of 15 degrees.

In practice, for the production of artificial snow from the device 1 for producing artificial snow of FIGS. 5 and 6, the central jet of water 201, the peripheral jet of air 211 and the nucleation jet 121 are produced simultaneously by activation of dedicated control means.

To generate the central jet of water 201, the single water spraying nozzle 202 is fed by pressurized-water supply means so as to spray water as droplets. The central jet of water 201 is of solid or hollow, conical shape.

In a not-shown alternative embodiment, it could be contemplated different means for producing the water jet, so that the central jet of water has an elliptical internal and/or external contour.

To generate the peripheral jet of air 211, the propeller 31 is rotated to create a vacuum in the internal housing 21 of the pipe 2, which forms an aspiration of air at the inlet 22, and said peripheral jet of air 211 at the outlet 23.

Hence, the peripheral jet of air 211 is herein hollow, of conical shape, defined by the external contour 213 and the internal contour 214.

The internal contour 214 of the peripheral jet of air 211 hence delimits a volume, within which the central jet of water 201 is projected.

For an optimal production of artificial snow, the peripheral jet of air 211 is projected over the whole perimeter of the central jet of water 201 so that the internal contour 214 of the peripheral jet of air 211 and the external contour 203 of the central jet of water 201 extend parallel or substantially parallel to each other at the outlet 23 of the pipe 2.

Hence, the central jet of water 201 is then a little "protected" and/or "isolated" from the atmosphere by the peripheral jet of air 211, up to a certain distance from the outlet 23 of the pipe 2.

This distance depends in particular on the shape and speed of the central jet of water 201 and the peripheral jet air 211.

The peripheral jet of air 211 and the central jet of water 201 are propelled at speeds identical to each other, to within 20%.

Possibly, it may be provided that the peripheral jet of air 211 has a speed higher by 20% than the speed of the central jet of water 201.

Finally, the nucleation jet 221 is generated as mentioned above, to produce the artificial snow.

The invention claimed is:

1. A device for producing artificial snow, the device comprising:

a central jet system configured to produce a central jet consisting of a first fluid chosen among air or water, said central jet including an external contour and an axis of projection;

a peripheral jet system configured to produce a peripheral jet consisting of a second fluid chosen among water or air and being different from said first fluid, said peripheral jet having a generally tubular shape defining an internal contour and an axis of projection, said peripheral jet being projected over the whole or substantially the whole periphery of said central jet; and a nucleation jet system configured to produce at least one nucleation jet to form crystals of ice, to produce artificial snow from the cooperation of said central and peripheral jets, wherein the central jet system and the peripheral jet system are configured such that the opposite contours of the respective jets each define a generating line, the generating lines of each of the respective jets defining between each other an angle of between −5° and 5°, at least in an initial portion thereof, following production thereof, the nucleation system is distributed over the external periphery of the peripheral jet system, and an axis of projection of the nucleation jet of the nucleation system defines a convergent angle of between 0° and 15° with respect to the axis of projection of the central jet.

2. The device according to claim 1, wherein the central jet system and the peripheral jet system are configured such that opposite contours thereof are generally cylindrical, conical, or elliptical in shape.

3. The device according to claim 1, wherein the peripheral jet system is configured to project water, and the central jet system is configured to project air.

4. The device according to claim 3, wherein the central jet system that projects the central jet of air and the peripheral jet system that projects the peripheral jet of water are disposed such that the internal contour of said peripheral jet of water conforms, at least approximately, to the external contour of said central jet of air.

5. The device according to claim 3, wherein the peripheral jet system that projects the peripheral jet of water is configured to project a juxtaposition of a plurality of individual jets of water to form together said peripheral jet of water, each of said individual jets of water extending tangentially, or substantially tangentially, to the external contour of the central jet of air.

6. The device according to claim 5, wherein the peripheral jet system that projects the peripheral jet of water is configured to project a juxtaposition of a plurality of individual jets of water each having a cross-section that is generally flat, conical or elliptical in shape.

7. The device according to claim 5, wherein the peripheral jet system that projects the peripheral jet of water comprises at least one crown of nozzles configured to each project one of the individual jets of water.

8. The device according to claim 1, wherein the peripheral jet system is configured to project air, and the central jet system is configured to project water.

9. The device according to claim 8, wherein the central jet system that projects the central jet of water comprises at least one nozzle configured to project an individual jet of water.

10. The device according to claim 1, wherein the central jet system projects a central jet of air and comprises a pipe provided with an outlet delimited by an outer envelope configured to define the external contour of said central jet.

11. The device according to claim 10, wherein the pipe comprises a planar support ring having a front face, perpendicular to the longitudinal axis of the pipe, serving as a support for one or more nozzles constituting the peripheral jet system and nozzles constituting the nucleation system.

12. A method for producing artificial snow, the method comprising:

producing a central jet consisting of a first fluid chosen among air or water, said central jet having an external contour and an axis of projection;

producing a peripheral jet consisting of a second fluid chosen among water or air and being different from said first fluid, said peripheral jet having a generally tubular shape defining an internal contour and an axis of projection, said peripheral jet being projected over the whole or substantially the whole periphery of said central jet;

producing at least one nucleation jet configured to form crystals of ice, to produce artificial snow from the cooperation of said central and peripheral jets, the at least one nucleation jet being distributed over the external periphery of said central and peripheral jets, the opposite contours of the central and peripheral jets defining between each other an angle of between −5° and 5°, at least in an initial portion thereof, following production thereof, and the speed of the water jet is equal to the speed of the air jet, to within 20%.

13. The device according to claim 4, wherein the peripheral jet system that projects the peripheral jet of water is configured to project a juxtaposition of a plurality of individual jets of water to form together said peripheral jet of water, each of said individual jets of water extending tangentially, or substantially tangentially, to the external contour of the central jet of air.

14. The device according to claim 13, wherein the peripheral jet system that projects the peripheral jet of water is configured to project a juxtaposition of a plurality of individual jets of water each having a cross-section that is generally flat, conical or elliptical in shape.

15. The device according to claim 6, wherein the peripheral jet system that projects the peripheral jet of water comprises at least one crown of nozzles configured to each project one of the individual jets of water.

16. The device according to claim 8, wherein the peripheral jet system comprises a pipe provided with an outlet delimited by an outer envelope and an inner envelope, respectively configured to define the external contour and the internal contour of the peripheral jet of air.

17. The device according to claim 16, wherein the pipe comprises a planar support ring having a front face, perpendicular to the longitudinal axis of the pipe, serving as a support for nozzles constituting the nucleation system.

* * * * *